US009429033B2

(12) United States Patent
Martin et al.

(10) Patent No.: US 9,429,033 B2
(45) Date of Patent: Aug. 30, 2016

(54) DRIVE ARRANGEMENT FOR A UNISON RING OF A VARIABLE-VANE ASSEMBLY

(71) Applicant: Honeywell International Inc., Morristown, NJ (US)

(72) Inventors: Steven P. Martin, Walnut, CA (US); Petr Stratil, Brno (CZ); Raduz Zahoransky, Koberice u Brna (CZ)

(73) Assignee: Honeywell International Inc., Morris Plains, NJ (US)

( * ) Notice: Subject to any disclaimer, the term of this patent is extended or adjusted under 35 U.S.C. 154(b) by 484 days.

(21) Appl. No.: 14/075,061

(22) Filed: Nov. 8, 2013

(65) Prior Publication Data

US 2015/0132111 A1 May 14, 2015

(51) Int. Cl.

| | |
|---|---|
| ***F01D 17/16*** | (2006.01) |
| ***F02C 6/12*** | (2006.01) |
| ***F01D 9/04*** | (2006.01) |

(52) U.S. Cl.

CPC ..... *F01D 17/16* (2013.01); *F01D 9/04* (2013.01); *F01D 17/165* (2013.01)

(58) Field of Classification Search

CPC ..... F01D 9/04; F01D 9/045; F01D 17/16; F01D 17/165; F05D 2220/40

See application file for complete search history.

(56) References Cited

U.S. PATENT DOCUMENTS

| | | | | |
|---|---|---|---|---|
| 3,990,809 | A | 11/1976 | Young et al. | |
| 4,741,666 | A | 5/1988 | Shimizu et al. | |
| 6,527,508 | B2 | 3/2003 | Groskreutz et al. | |
| 6,546,728 | B2 * | 4/2003 | Schmidt | F01D 17/12 415/150 |
| 7,114,919 | B2 | 10/2006 | Scholz et al. | |
| 7,886,536 | B2 * | 2/2011 | Hemer | F01D 17/165 415/159 |
| 2012/0279217 | A1 * | 11/2012 | Eriksson | F01D 17/165 60/605.1 |
| 2014/0161595 | A1 * | 6/2014 | Tashiro | F02B 37/24 415/146 |
| 2015/0167685 | A1 * | 6/2015 | Krausche | F01D 17/165 415/146 |

FOREIGN PATENT DOCUMENTS

| | | | |
|---|---|---|---|
| EP | 1236867 | A2 | 9/2002 |
| EP | 2131012 | A2 | 12/2009 |
| EP | 2239425 | A2 | 10/2010 |
| WO | 2011961422 | A1 | 6/2011 |
| WO | 2013946155 | A1 | 4/2013 |

OTHER PUBLICATIONS

EPO Search Report and Opinion dated May 4, 2015 in application # 14188020.3-1610.

"*BWTS Production Fork & Block*;" Honeywell; dated Jan. 17, 2014.

* cited by examiner

*Primary Examiner* — Nathaniel Wiehe
*Assistant Examiner* — Brian O Peters
(74) *Attorney, Agent, or Firm* — John C. James

(57) ABSTRACT

A variable-vane assembly has a nozzle ring supporting an array of pivotable vanes, and a unison ring for pivoting the vanes in unison. A crank mechanism rotatably drives the unison ring, and includes an external crank assembly positioned radially outward of the unison ring, a non-round drive block disposed in a non-round recess in an outer periphery of the unison ring, and a crank arm having a forked end connected to the drive block and an opposite end connected to the external crank assembly. The forked end defines two legs and the drive block is disposed between the legs and is pivotally connected to the legs such that the drive block is pivotable relative to the crank arm about a pivot axis. The crank mechanism is arranged such that the crank arm is caused to swing through an arc of movement, thereby rotating the unison ring.

7 Claims, 4 Drawing Sheets

DRIVE ARRANGEMENT FOR A UNISON RING OF A VARIABLE-VANE ASSEMBLY

BACKGROUND OF THE INVENTION

The present invention relates to turbochargers having a variable-nozzle turbine in which an array of movable vanes is disposed in the nozzle of the turbine for regulating exhaust gas flow into the turbine.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

Typically the variable-vane assembly includes a nozzle ring that rotatably supports the vanes adjacent one face of the nozzle ring. The vanes have axles that extend through bearing apertures in the nozzle ring, and vane arms are rigidly affixed to the ends of the axles projecting beyond the opposite face of the nozzle ring. Thus the vanes can be pivoted about the axes defined by the axles by pivoting the vane arms so as to change the setting angle of the vanes. In order to pivot the vanes in unison, an actuator ring or "unison ring" is disposed adjacent the opposite face of the nozzle ring and includes recesses in its radially inner edge for receiving free ends of the vane arms. Accordingly, rotation of the unison ring about the axis of the nozzle ring causes the vane arms to pivot and thus the vanes to change setting angle.

There is a challenge in terms of how the unison ring is rotatably driven. Typically a crank aim located adjacent the unison ring is connected to an actuator, which operates to cause the crank arm to pivot in one direction or the opposite direction. The end of the crank arm has a portion of generally cylindrical configuration that is engaged in a correspondingly shaped recess in a radially outer periphery of the unison ring. The generally cylindrical engagement portion can pivot in the recess. Pivoting of the crank arm is translated into rotational motion of the unison ring about its axis.

The interface between the generally cylindrical engagement portion of the crank arm and the unison ring bears loads arising from vane loading, internal friction of the VNT mechanism, and vibrations. Accordingly, this interface tends to see a significant amount of wear over time.

BRIEF SUMMARY OF THE DISCLOSURE

The present disclosure relates to a variable-vane assembly for a variable nozzle turbine such as used in a turbocharger. In one embodiment described herein, the variable-vane assembly comprises a nozzle ring having opposite first and second faces, and a plurality of vanes adjacent the second face of the nozzle ring and having respective axles received into apertures in the nozzle ring and being rotatable in the apertures such that the vanes are rotatable about respective axes defined by the axles, a distal end of each axle projecting out from the respective aperture beyond the first face. The assembly includes a plurality of vane arms respectively affixed rigidly to the distal ends of the axles, each vane aim having a free end, and a unison ring positioned adjacent the nozzle ring with a first face of the unison ring opposing the first face of the nozzle ring. The unison ring is connected to the free ends of the vane arms, the unison ring being rotatable about a rotation axis so as to pivot the vane arms about the vane axes, thereby pivoting the vanes in unison.

The variable-vane assembly includes a crank mechanism for rotatably driving the unison ring to pivot the vanes. The crank mechanism includes an external crank assembly positioned radially outward of the unison ring, a non-round drive block disposed in a correspondingly shaped non-round recess in an outer periphery of the unison ring such that the drive block is prevented from rotating relative to the unison ring, and a crank arm having a forked end connected to the drive block and an opposite end connected to the external crank. The forked end defines two legs spaced apart in a direction parallel to the rotation axis of the unison ring. The drive block is disposed between the legs and is pivotally connected to the legs such that the drive block is pivotable relative to the crank aim about a pivot axis that is generally parallel to the rotation axis of the unison ring. The crank mechanism is arranged such that the crank arm is caused to swing through an arc of movement about an axis located at the opposite end of the crank arm, thereby rotating the unison ring.

Advantageously, the drive block and the recess are configured such that the drive block is slidable in the recess in a radial direction of the unison ring, such that the drive block is able to undergo radial movement with respect to the unison ring as the crank aim swings through the arc of movement. The combination of the drive block's ability to pivot relative to the crank arm and its ability to radially move relative to the unison ring leads to a substantial alleviation of contact stresses between the drive block and unison ring. Additionally, the amount of contact surface area between the drive block and unison ring is increased relative to conventional main arm/unison ring interfaces, with the result that contact pressures are reduced and surface wear accordingly is diminished.

Also described herein is a particular construction of the connection between the forked end of the crank arm and the drive block. Two protrusions respectively extend from two opposite faces of the drive block, and each of the legs of the forked end is affixed to a respective one of the protrusions. In one embodiment, the protrusions comprise opposite ends of a pin that extends through a bore in the drive block. The opposite ends of the pin can be rigidly affixed (e.g., by press-fitting or welding) to the legs of the forked end. The pin can include a cylindrical portion residing in the bore in the drive block and being rotatable relative to the drive block about an axis of the bore.

The first face of the nozzle ring can include a machined pocket to accommodate one of the legs of the forked end of the crank arm.

In accordance with the arrangement described herein, the unison ring, vane arms, and crank arm all lie in substantially the same plane, thereby substantially reducing any out-of-plane forces on these components.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
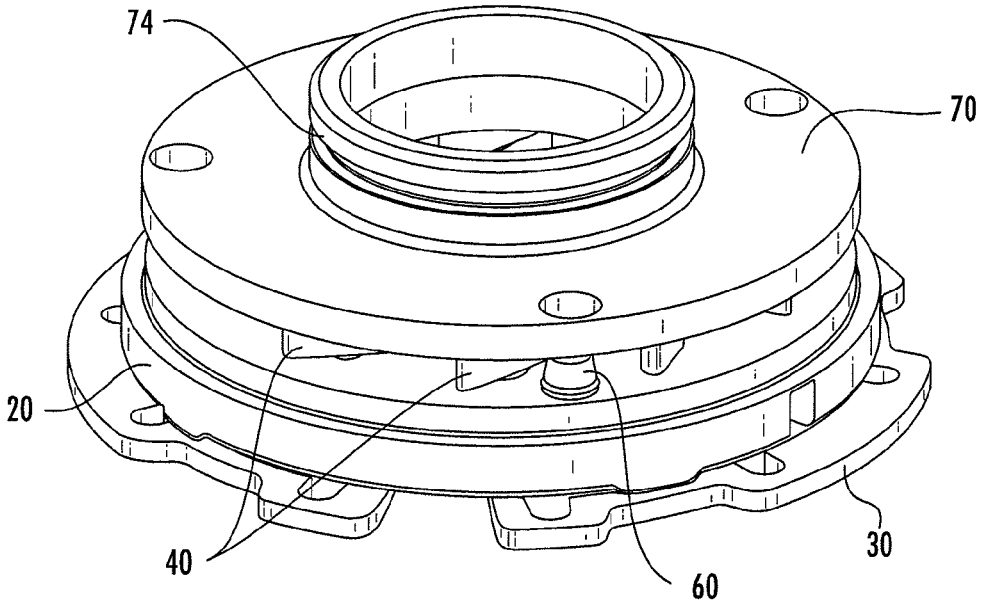
FIG. 1 is a perspective view of a variable vane assembly in accordance with one embodiment of the invention.
Figure 2:
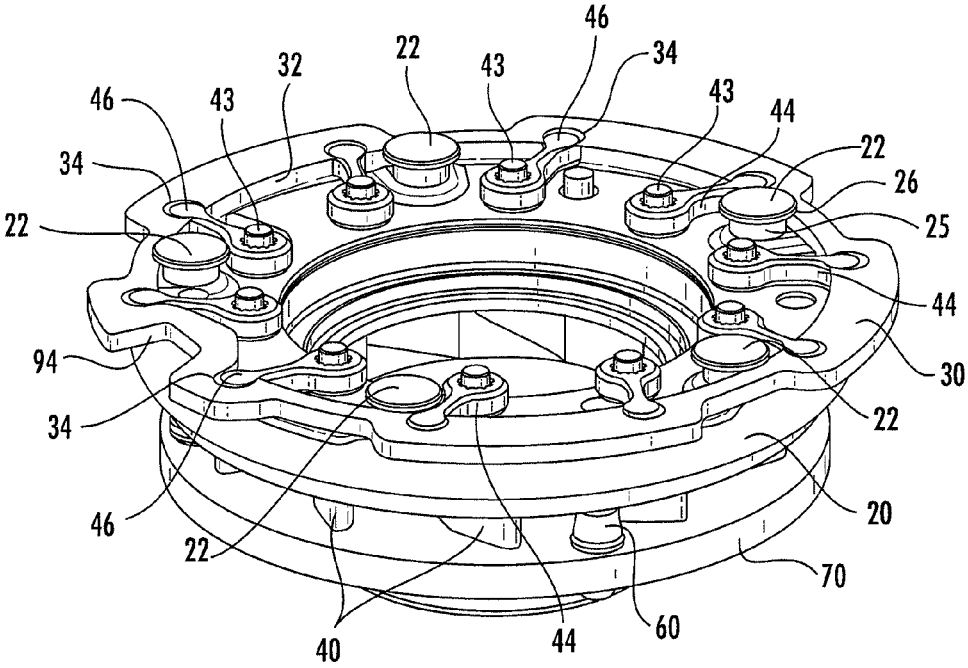
FIG. 2 is a perspective view of the assembly of FIG. 1, turned upside down relative to the orientation in FIG. 1.

FIGS. 1 and 2 show perspective views (respectively right-side up and upside down) of a variable-vane assembly in accordance with one embodiment of the present invention. The variable-vane assembly includes a nozzle ring 20 having mounted thereon a plurality of guide pins 22. The nozzle ring has a plurality of circumferentially spaced first apertures extending into a first face of the nozzle ring for receiving the guide pins 22. More particularly, each guide pin has a generally cylindrical end portion of relatively small diameter that is sized to fit into a corresponding first aperture with an interference fit. The end portions of the guide pins 22 are press-fit into the first apertures, such that guide portions of the guide pins project axially from the first face of the nozzle ring as shown in FIG. 2. The guide portion of each guide pin includes a shank 25 and a shoulder 26 of larger diameter than the shank 25. In the illustrated embodiment shown in FIG. 2, there are five guide pins 22 spaced approximately uniformly about the circumference of the nozzle ring 20, but it is equally feasible to employ a different number of guide pins and/or to space the guide pins non-uniformly about the circumference.

The variable-vane assembly also includes a unison ring 30. The unison ring has a radially inner edge 32 that is smaller in diameter than the maximum diameter defined collectively by the shoulders 26 of the guide portions of the guide pins 22. In other words, the shoulders 26 of the guide pins radially overlap the radially inner edge 32 of the unison ring. The largest diameter collectively defined by the shanks 25 of the guide pins is very slightly smaller than or about equal to the diameter of the inner edge 32 of the unison ring 30. Accordingly, the unison ring is located relative to the guide pins such that the inner edge 32 of the unison ring is captive (in the axial direction) between the shoulders 26 of the guide pins and the nozzle ring 20. At the same time, the shanks 25 of the guide pins 22 restrain the unison ring against radial movement relative to the nozzle ring.

The variable-vane assembly includes a plurality of spacers 60 (only one such spacer being visible in FIGS. 1 and 2) rigidly affixed to the nozzle ring 20 and projecting axially from the second face of the nozzle ring for engagement with a turbine housing insert 70. The turbine housing insert 70 has three apertures for receiving end portions of the spacers 60. The spacers have shoulders or radial bosses that abut the second face of the nozzle ring 20 and the opposite face of the insert 70 so as to dictate the axial spacing between these faces. The spacers are rigidly affixed to the nozzle ring and insert, such as by orbital riveting or any other suitable process. The turbine housing insert 70 in the illustrated embodiment is configured with a tubular portion 74 to be inserted into the bore of a turbine housing in a turbocharger. In other non-illustrated embodiments, the insert may not include such a tubular portion. The nozzle ring 20 and insert 70 (which together constitute a nozzle ring set) cooperate to form a passage therebetween, and a plurality of variable vanes 40 are arranged in the passage and preferably extend in the axial direction fully across the passage so that fluid flowing through the passage is constrained to flow through the spaces between the vanes.

With further reference to FIG. 2, each vane 40 has at least one axle 43 rigidly affixed thereto. In the illustrated embodiment, the axles 43 are inserted through corresponding second apertures in the nozzle ring 20, which apertures extend entirely through the nozzle ring from the first face to an opposite second face thereof. The axles 43 are inserted into the apertures from the second face, and distal ends of the axles 43 extend beyond the first face. In other non-illustrated embodiments, the vanes may each include a second axle that projects from the opposite side of the vane from the axle 43, and the second axles are received into apertures formed in the insert 70.

The variable-vane assembly further includes a plurality of vane arms 44. The setting angles of the vanes 40 are changed by rotating the vanes about the axes defined by the vane axles 43, whereby the vane axles rotate in their respective second apertures in the nozzle ring 20. A vane arm 44 is engaged with the distal end of each vane axle 43. Each vane arm has a free end 46 that is engaged in a recess 34 in the inner edge of the unison ring 30. The vanes 40 are positioned such that all of the vanes have the same setting angle, and then the vane arms are rigidly affixed to the distal ends of the axles 43, such as by welding or by a riveting process. Rotation of the unison ring 30 about its central axis causes the vane arms 44 to pivot, thereby pivoting the vanes 40 in unison.

The entire variable-vane assembly of FIGS. 1 and 2 forms a unit (also referred to as a cartridge) that is installable into the turbine housing. The turbine housing is then connected to a center housing of the turbocharger such that the variable-vane assembly is captured between the turbine and center housings.

In accordance with one embodiment of the present invention, the crank mechanism for rotating the unison ring 30 is particularly configured to address the problem of wear at the interface between the crank mechanism and the unison ring arising from loads caused by vane aerodynamic loading, internal friction of the VNT mechanism, and vibrations. Thus, with reference to FIGS. 3 and 4, a crank mechanism 80 in accordance with one embodiment of the invention is illustrated. The crank mechanism 80 includes an external crank assembly 82 positioned radially outward of the unison ring 30. The external crank assembly comprises a drive aim 84 connected to one end of a drive shaft 86. A central axis of the drive shaft 86 extends generally parallel to the rotation axis of the unison ring 30 but is spaced radially outward of the outer edge of the unison ring. The opposite end of the drive shaft 86 is connected to a crank arm 88 having a forked end defining two legs 89 spaced apart in a direction parallel to the rotation axis of the unison ring.

The forked end of the crank arm 88 is connected to a non-round drive block 92 via a pin 90 that extends through apertures in each leg 89 and through an aperture extending through the drive block 92. The drive block 92 is disposed in a correspondingly shaped non-round recess 94 in the outer periphery of the unison ring 30 such that the drive block is prevented from rotating relative to the unison ring. The pin 90 coupling the forked end of the crank arm 88 to the drive block 92 can be rigidly affixed to the block and can be pivotally connected to the legs 89 such that the drive block 92 is pivotable relative to the crank arm 88 about a pivot axis that is generally parallel to the rotation axis of the unison ring. Alternatively, the opposite ends of the pin 90 can be rigidly affixed to the legs 89 of the forked end, and the pin 90 can include a cylindrical portion residing in a bore in the drive block 92 such that the pin 90 is rotatable relative to the drive block 92 about an axis of the bore. (see FIG. 4). Thus, the crank mechanism is arranged such that the crank arm 88 is caused by the drive arm 84 to swing through an arc of movement about an axis A (FIG. 4) located at the opposite end of the crank arm (defined by the drive shaft 86), thereby rotating the unison ring 30 about its axis.

Figure 3:
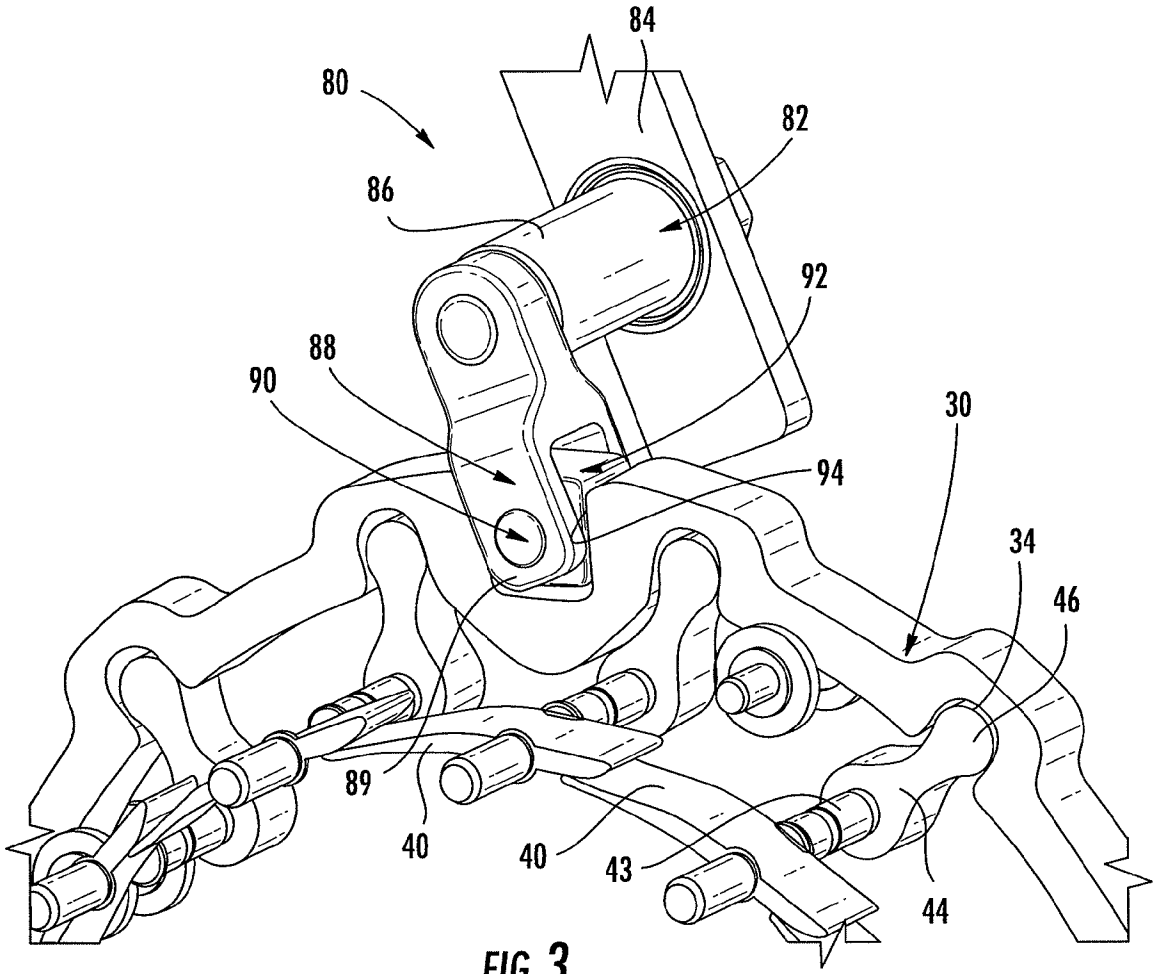
FIG. 3 is a fragmentary perspective view of a partial assembly including a unison ring, vane arms, vanes, crank arm, drive block, and external crank assembly, in accordance with an embodiment of the invention.
Figure 4:
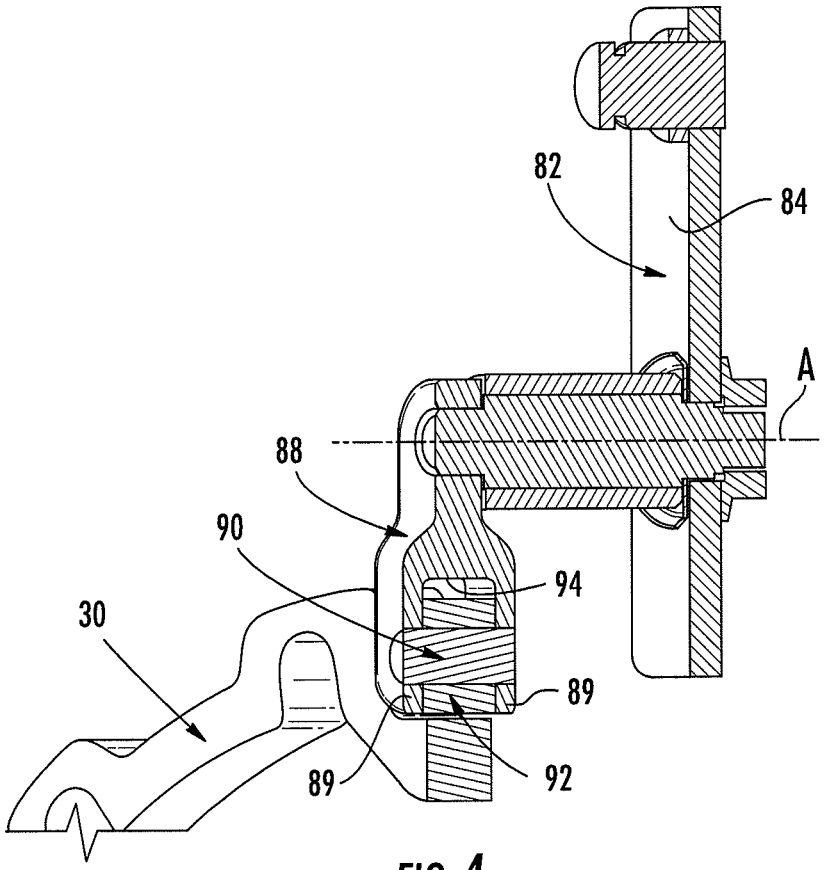
FIG. 4 is a sectioned perspective view of the unison ring, drive block, crank arm, and external crank assembly in accordance with an embodiment of the invention.

It will be recognized from FIGS. 3 and 4 that the unison ring 30, the vane arms 44, and the crank arm 88 are all substantially co-planar. Consequently, the forces imparted to the unison ring by the block 92 and the forces imparted to the unison ring by the vane arms 44 all act in the common plane. This means there is a substantial absence of out-of-plane forces on the unison ring.

For space-saving reasons, the first face of the nozzle ring 20 can include a machined pocket to accommodate one of the legs 89 of the forked end of the crank arm.

Preferably but not essentially, the drive block 92 and the recess 94 that receives it are configured such that the drive block is slidable in the recess in a radial direction (generally up and down in FIG. 3) of the unison ring, such that the drive block is able to undergo radial movement with respect to the unison ring as the crank arm 88 swings through the arc of movement. The combination of the drive block's ability to pivot relative to the crank arm and its ability to radially move relative to the unison ring leads to a substantial alleviation of contact stresses between the drive block and unison ring, and hence reduced wear of their contact surfaces.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A variable-vane assembly for a turbocharger, comprising:

a nozzle ring having opposite first and second faces;

a plurality of vanes adjacent the second face of the nozzle ring and having respective axles received into apertures in the nozzle ring and being rotatable in the apertures such that the vanes are rotatable about respective vane axes defined by the axles in the apertures, a distal end of each axle projecting out from the respective aperture beyond the first face;

a plurality of vane arms respectively affixed rigidly to the distal ends of the axles, each vane arm having a free end;

a unison ring positioned adjacent the nozzle ring with a first face of the unison ring opposing the first face of the nozzle ring, the unison ring being connected to the free ends of the vane arms, the unison ring being rotatable about a rotation axis so as to pivot the vane arms about the vane axes, thereby pivoting the vanes in unison; and a crank mechanism for rotatably driving the unison ring to pivot the vanes, the crank mechanism including an external crank assembly positioned radially outward of the unison ring, a non-round drive block disposed in a correspondingly shaped non-round recess in an outer periphery of the unison ring such that the drive block is prevented from rotating relative to the unison ring, and a crank arm having a forked end connected to the drive block and an opposite end connected to the external crank assembly, the forked end defining two legs spaced apart in a direction parallel to the rotation axis of the unison ring, the drive block being disposed between the legs and being pivotally connected to the legs such that the drive block is pivotable relative to the crank arm about a pivot axis that is generally parallel to the rotation axis of the unison ring, the crank mechanism being arranged such that the crank arm is caused to swing through an arc of movement about an axis located at the opposite end of the crank arm, thereby rotating the unison ring.

2. The variable-vane assembly of claim 1, wherein the unison ring, the vane arms, and the crank arm are all substantially co-planar.

3. The variable-vane assembly of claim 1, wherein the drive block and the recess are configured such that the drive block is slidable in the recess in a radial direction of the unison ring, such that the drive block is able to undergo radial movement with respect to the unison ring as the crank arm swings through the arc of movement.

4. The variable-vane assembly of claim 1, wherein two protrusions respectively extend from two opposite faces of the drive block, and each of the legs of the forked end is affixed to a respective one of the protrusions.

5. The variable-vane assembly of claim 4, wherein the protrusions comprise opposite ends of a pin that extends through a bore in the drive block.

6. The variable-vane assembly of claim 5, wherein the opposite ends of the pin are rigidly affixed to the legs of the forked end, and the pin includes a cylindrical portion residing in the bore in the drive block, the pin being rotatable relative to the drive block about an axis of the bore.

7. The variable-vane assembly of claim 1, wherein the first face of the nozzle ring includes a machined pocket to accommodate one of the legs of the forked end of the crank arm.

* * * * *